United States Patent [19]

Koike

[11] 4,282,110

[45] Aug. 4, 1981

[54] ANTIBACTERIAL SOAP

[75] Inventor: Mamoru Koike, Kashiwa, Japan

[73] Assignee: Kao Soap Co., Ltd., Tokyo, Japan

[21] Appl. No.: 93,522

[22] Filed: Nov. 13, 1979

[30] Foreign Application Priority Data

Dec. 22, 1978 [JP] Japan ..... 53-159628

[51] Int. Cl.[3] ..... C11D 9/14; C11D 9/50

[52] U.S. Cl. ..... 252/107; 252/109

[58] Field of Search ..... 252/106, 107, 109

[56] References Cited

U.S. PATENT DOCUMENTS

| | | | |
|---|---|---|---|
| 2,234,379 | 3/1941 | Martin | 252/109 |
| 3,284,362 | 11/1966 | Zussman | 252/107 |
| 3,625,903 | 12/1971 | Davies et al. | 252/107 |
| 3,700,601 | 10/1972 | Bloching | 252/105 |
| 3,723,326 | 3/1973 | Cheng et al. | 252/107 |
| 4,115,294 | 9/1978 | Fearnley et al. | 252/106 |

FOREIGN PATENT DOCUMENTS

| | | | |
|---|---|---|---|
| 1943694 | 3/1971 | Fed. Rep. of Germany | 252/106 |

*Primary Examiner*—P. E. Willis, Jr.

*Attorney, Agent, or Firm*—Oblon, Fisher, Spivak, McClelland & Maier

[57] ABSTRACT

An antibacterial soap comprising 2,4,4'-trichloro-2'-hydroxydiphenylether in amounts of 0.05 to 5% by weight and at least one of an inorganic phosphorus oxyacid and a salt thereof has a wide range of antibacterial activities and marked resistance to discoloration upon exposure to sunlight.

4 Claims, No Drawings

ANTIBACTERIAL SOAP

BACKGROUND OF THE INVENTION

1. Field of the Invention

This invention relates to soaps suitable for skin and hair treatment and has particular reference to a novel antibacterial soap which comprises 2,4,4'-trichloro-2'-hydroxydiphenylether and one or more of an inorganic phosphorus oxyacid and a salt thereof.

2. Description of the Prior Art 2,4,4'-Trichloro-2'-hydroxydiphenylether is a known compound which possesses broad antibacterial spectrum characteristics for microorganisms such as Gram-positive and -negative bacteria, mold, yeast and the like. Moreover, the compound has lower toxic and irritating effects upon the skin and mucous membrane of human beings. Because of such substantial advantages, the compound is useful as a good antibacterial agent for inhibiting any noxious microorganisms which would adhere to the skin and hair, and therefore, can be expected to find wide application to soaps, shampoos, detergents, cosmetics, ointments and similar articles.

However, such antibacterial compound or 2,4,4'-trichloro-2'-hydroxydiphenylether is encountered with the drawback that the compound when incorporated into any conventional soap bases causes the resulting soaps to discolor or become dark brown when they are exposed to sunlight. Although discoloration in the soaps does not induce adverse effects upon the antibacterial action of the compound, nevertheless it mars attractive appearance of the soap product and makes the user feel uneasy. This problem is particularly detrimental to commercial acceptance of generally light-colored soaps. Accordingly, a need continues to exist for an antibacterial soap which produces no color deterioration even upon exposure to sunlight.

In fact, various attempts have been made to reduce, retard or prevent color formation in the soaps of the type described, and some reports on the problem have been made public. According to U.S. Pat. No. 3,284,362, an aromatic carboxylic acid or an alkali metal salt thereof is employed as a discolor-preventing agent in a soap composition. The use of a $C_8$–$C_{22}$ substantially straight-chain fatty acid is disclosed in U.S. Pat. No. 3,625,903 and Japanese Pat. publication No. 47-20629. On the other hand, Japanese Pat. publication No. 52-43207 is concerned with the prevention of a soap from discoloration with the aid of an organic acid such as malonic acid, citric acid or malic acid. It has now been found that satisfactory results cannot still be obtained by such prior art techniques.

The present inventor has made many studies concerning minimizing or avoiding color formation or discoloration in a variety of antibacterial soaps into which 2,4,4'-trichloro-2'-hydroxydiphenylether is incorporated. As a result of those studies, it has been discovered that particular phosphoric oxyacids and salts thereof exhibit excellent discolor-preventing characteristics and are surprisingly efficient in keeping the soaps against discoloration. The present invention bases its achievement upon this discovery.

SUMMARY OF THE INVENTION

It is an object of the present invention to provide a novel antibacterial soap which eliminates the above noted drawbacks of the conventional antibacterial soaps.

Another object of the invention is to provide a novel antibacterial soap which exhibits a wide range of antibacterial activities and is protected against color formation upon exposure to sunlight and which is very stable in physical properties and does not irritate the skin.

In accordance with the invention, there is provided an antibacterial soap which comprises 2,4,4'-trichloro-2'-hydroxydiphenylether in amounts of 0.05 to 5% by weight and at least one of an inorganic phosphorus oxyacid and a salt thereof.

These and other objects and advantages of the invention will become apparent from the detailed description and claims which follow hereinafter.

By the term soap is meant a cleansing material in the form of a bar or flake.

DETAILED DESCRIPTION OF THE PREFERRED EMBODIMENTS

Broadly stated, a novel antibacterial soap according to the present invention is produced by incorporating into a solid or powdered soap base 2,4,4'-trichloro-2'-hydroxydiphenylether as an antibacterial agent and at least one of a phosphoric oxyacid and a salt thereof as a discolor-preventing agent.

Typical examples of inorganic phosphorus oxyacids and salts thereof which are useful in the invention include phosphoric acid, hypophosphoric acid, phosphorous acid and hypophosphorous acid, and an alkali metal salt thereof such as sodium or potassium, and an ammonium salt.

More particularly, examples of inorganic phosphorus oxyacids and salts thereof for use in the invention include orthophosphoric acid, primary phosphate, secondary phosphate, tertiary phosphate, pyrophosphoric acid, acid pyrophosphate, neutral pyrophosphate, polymetaphosphate, hypophosphoric acid, acid hypophosphate, neutral hypophosphate, phosphorous acid, primary phosphite, secondary phosphite, pyophosphite, polymetaphosphite, hypophosphorous acid and hypophosphite. Of these inorganic phosphorus oxyacids and salts thereof, preferably useful are orthophosphoric acid, primary sodium phosphate, primary potassium phosphate, primary ammonium phosphate, pyrophosphoric acid, acid sodium pyrophosphate, acid potassium pyrophosphate, triphosphoric acid, tetraphosphoric acid, trimetaphosphoric acid, tetrametaphosphoric acid, hypophosphoric acid, acid sodium hypophosphate, phosphorous acid, primary sodium phosphite, primary potassium phosphite, pyrophosphorous acid, polymetaphosphorous acid and hypophosphorous acid. Especially desirable are phosphoric acid, primary alkalimetal- or ammonium phosphate, pyrophosphoric acid, acid alkalimetal- or ammonium pyrophosphate, triphosphoric acid, tetraphosphoric acid, trimetaphosphoric acid, tetraphosphoric acid, hypophosphoric acid and phosphorous acid.

The amount of the antibacterial compound or 2,4,4'-trichloro-2'-hydroxydiphenylether may vary, depending on the intended use of the soap, and is practically in a range of about 0.05 to 5% by weight. Moreover, the discolor-preventing agent, that is, any selected one inorganic phosphorus oxyacid or salt thereof, may be added in amounts of about 0.01 to 10%, preferably 0.1 to 2% by weight. The addition of the discolor-preventing agent in smaller amounts of less than the lower limits fails to impart sufficient effects, whereas larger amounts of more than the upper limit show no appreciable increase in the effectiveness and adversely affects the physical properties of the soap, thereby resulting in cracked or otherwise deteriorated soap product. Consequently, the discolor-preventing agent should be added in the amounts specified above for satisfactory results.

Other desired ingredients can be advantageously utilized in the antibacterial soap of this invention in combination with the antibacterial and discolor-preventing agents. Such ingredients are germicides, anti-inflammatory agents, forming additives, antioxidants, perfumes and pigments, and may be included individually or in combination in any convenient manner.

Suitable germicides include 3,4,4'-trichlorocarbanilide (TCC) and 3-trifluoromethyl-4,4'-dichlorocarbanilide ($CF_3$). Suitable anti-inflammatory agents include 5-ureidohydantoin (allantoin), dipotassium glycyrrhetate and diammonium glycyrrhetate. Suitable foaming additives include superfatting agents such as lanolin, lanolin derivatives, fatty acids, fatty acid esters, higher alcohols and alkylalkanolamides. Further, suitable antioxidants include butylated hydroxytoluene, butylated hydroxyanisole, tocopherol, and L-ascorbic acid and esters or salts thereof.

This invention will now be described in more detail with reference to certain specific Examples which indicate preferred embodiments of the invention by way of illustration only.

EXAMPLE I

Sample antibacterial soaps were prepared by mixing the following ingredients in the usual manner known in the art. After exposure to direct sunlight for 5 days in the midsummer, the varying degrees of discoloration of the soaps were observed. A soap made in a similar fashion but unexposed and kept in dark cooled conditions was used as a standard of comparison.

The results obtained are shown in Table 1.

Soap Formulation:

| | |
|---|---|
| Soap base | 100.0 g |
| Titanium dioxide | 0.1 g |
| Chelating agent (DETA-4Na) | 0.1 g |
| 2,4,4-Trichloro-2'-hydroxydiphenylether | 0.5 g |
| Discolor-preventing agent | 0.5 g |

TABLE 1

| Test soaps | Discolor-preventing agents | Grades |
|---|---|---|
| Present soaps | Phosphoric acid | 0 |
| | Pyrophosphoric acid | 0 |
| | Monosodium phosphoric acid | 3 |
| | Acid potassium pyrophosphate | 4 |
| | Trimetaphosphoric acid | 2 |
| | Hypophosphoric acid | 3 |
| | Phosphorous acid | 3 |
| Comparative soaps | Lauric acid | 10 |
| | Succinic acid | 7 |
| | Citric acid | 7 |
| Control | Not added | 10 |

Grading Notations of Discoloration:

| | |
|---|---|
| 0: Not discolored or equal to the standard<br>1:<br>2: Discolored to a substantially small degree as compared to the standard<br>3:<br>4: Slightly discolored as compared to the standard | Commercially acceptable |
| 5:<br>6: Considerably discolored as compared to the standard<br>7: | Commercially questionable |
| 8: Extremely discolored as compared to the standard<br>9:<br>10: Wholly discolored or equal to the control | Commercially unacceptable |

EXAMPLE II

Antibacterial soaps were prepared in the same procedure as in Example I and tested to observe the relationship between the varying ratios of the discolor-preventing agent present in the soaps and the degrees of color stabilization and cracking.

The results obtained are shown in Table 2.

TABLE 2

| Discolor-preventing agent (phosphoric acid) | Grades of color stabilization | Degrees of grades of cracking |
|---|---|---|
| 0% by weight | 10 | 0 |
| 0.01 | 7 | 0 |
| 0.1 | 3 | 0 |
| 0.5 | 0 | 0 |
| 1 | 0 | 0 |
| 2 | 0 | 0 |
| 10 | 0 | 1 |
| 20 | 0 | 2 |

Test Method of Cracking:

Test pieces each having a dimension of 1 cm×1 cm×5 cm were cut out of the central portions of the sample soaps. Each cut was provided at one angular portion thereof with a thin metal wire and suspended by means of the wire in a test tube containing 40 ml of distilled water such that the cut was immersed in the water. Immersion was continued for 3 hours at a temperature of 10°±1° C.

Thereafter, the cut was taken out of the test tube and allowed to stand for 24 hours at room temperature. The degrees of cracking in the test pieces thus treated were observed and graded.

Grading Notations of Cracking:

0: Not cracked
1: Slightly cracked
2: Cracked with one relatively large stripe
3: Cracked with more than two relatively large stripes
4: Cracked with considerably large stripes on all sides
5: Cracked with much more stripes than grade 4

EXAMPLE III

Into a solid soap composition containing 100 g of a soap base, 0.1 g of titanium dioxide, 0.1 g of sodium ethylenediaminetetraacetate and 1.0 g of a perfume were incorporated 5 g of 2,4,4'-trichloro-2'-hydroxydiphenylether, 1.0 g of phosphoric acid and 1.0 g of acid sodium pyrophosphate. The thus obtained soap was exposed to light for 24 hours in a sunshine weathermeter with the results that no color formation developed in the soap.

EXAMPLE IV

Into a solid soap composition containing 100 g of a soap base 0.1 g of titanium dioxide, 0.1 g of sodium ethylenediaminetetraacetate and 1.0 g of a perfume were incorporated 5 g of 2,4,4'-trichloro-2'-hydroxydiphenylether, 0.1 g of pyrophosphoric acid and 1.0 g of monolauryl phosphoric acid. The thus obtained soap was exposed to direct sunlight of midsummer for 5 days with the results that no color formation developed in the soap.

What is claimed is:

1. An antibacterial soap comprising 2,4,4'-trichloro-2'-hydroxydiphenylether in amounts of 0.05 to 5% by weight and at least one discolor-preventing agent in amounts of 0.01 to 10% by weight selected from the group consisting of an inorganic phosphorus oxyacid and a salt thereof.

2. The antibacterial soap according to claim 1 wherein said inorganic phosphorus oxyacid is selected from the group consisting of orthophosphoric acid, pyrophosphoric acid, triphosphoric acid, tetraphosphoric acid, trimetaphosphoric acid, tetrametaphosphoric acid, hypophosphoric acid and phosphorous acid.

3. The antibacterial soap according to claim 1, wherein said inorganic phosphorus oxyacid salt is selected from the group consisting of primary phosphate and acid pyrophosphate.

4. The antibacterial soap according to claim 3, wherein said inorganic phosphorus oxyacid salt is an alkali metal or an ammonium salt.

* * * * *